United States Patent [19]
Rohrbach
[11] 4,232,749
[45] Nov. 11, 1980

[54] CONVERTIBLE ROTARY/PERCUSSION DRILL

[75] Inventor: Fritz Rohrbach, Pieterlen, Switzerland

[73] Assignee: Robert Bosch GmbH, Stuttgart, Fed. Rep. of Germany

[21] Appl. No.: 941,264

[22] Filed: Sep. 11, 1978

[30] Foreign Application Priority Data

Oct. 22, 1977 [CH] Switzerland ..... 2747537/77

[51] Int. Cl.² ..... B25D 15/00
[52] U.S. Cl. ..... 173/48; 74/22 A
[58] Field of Search ..... 74/22 A; 173/48, 47

[56] References Cited

U.S. PATENT DOCUMENTS

| | | | |
|---|---|---|---|
| 3,649,794 | 3/1972 | Densow | 200/157 |
| 3,777,825 | 12/1973 | Gullich | 173/48 X |
| 3,785,443 | 1/1974 | Armbruster | 173/48 |
| 3,799,275 | 3/1974 | Plattenhardt et al. | 173/48 |

FOREIGN PATENT DOCUMENTS 2158118 5/1973 Fed. Rep. of Germany .
2438763 3/1976 Fed. Rep. of Germany .

*Primary Examiner*—Lawrence J. Staab
*Attorney, Agent, or Firm*—Frishauf, Holtz, Goodman & Woodward

[57] ABSTRACT

The slider by means of which the drill is changed from rotary drilling to percussion drilling is made of plastic. It is formed as a single unit with end portions to be pushed to select a first position for the rotary drilling and a second position for percussion drilling, stop portions which abut against parts of the housing to stop the movement of the slider in one or the other direction, and elongated latching elements which have cam-like projections for engaging latching recesses in the housing thereby locking the slider in the first or second position. Deformation of a ball riding in an opening of the slider and acting as thrust bearing for the spindle during rotary drilling is prevented by a bearing plate inserted in a recess in the slider in the region of the opening receiving the ball, or a stationary steel plate mounted in a part of the housing along the path travelled by the slider.

7 Claims, 3 Drawing Figures

CONVERTIBLE ROTARY/PERCUSSION DRILL

The present invention relates to convertible rotary/-percussion drills.

BACKGROUND AND PRIOR ART

Convertible rotary/percussion drills are described, for example, in U.S. Pat. No. 3,785,443, Armbruster, assigned to the assignee of this application.

Convertible drills as known may be relatively complicated, subject to material fatigue and relatively difficult to assemble.

THE INVENTION

It is an object of the present invention to furnish a selection member for selectively operating a drill as a percussion drill or a rotary drill which is simple, reliable, and has a minimum number of parts thereby simplifying the alignment during assembly.

Briefly, a plastic slider is formed with at least one latching element for arresting the slider in a first and second end position in which the drill is operative, respectively, as a rotary and a percussion drill. The latching elements are elongated and have cam-like projections at their free ends which engage corresponding recesses in the housing. The plastic slider has end portions by means of which the slider is pushed from the first to the second position and vice versa. Separate elements for engaging the slider to be pushed are therefore eliminated.

For providing a thrust bearing for the spindle when the drill is operating as a rotary drill, the slider has an opening which receives a ball. In a preferred embodiment of the present invention, the slider has an additional recess in the region of this opening for receiving a bearing plate which, together with the ball, constitutes the thrust bearing for the spindle when the drill is operating as rotary drill. The use of a small hardened bearing plate made of steel assures a long life and a relatively foolproof conversion for the drill. Alternatively, a stationary steel plate may be mounted in the part of the housing opposite the slider and extending in the direction of travel of the slider. This stationary steel plate can serve as a sliding surface for the above mentioned moveable plate or, alternatively, the moveable plate can be eliminated and the thrust bearing would then comprise the ball and the stationary steel plate. The selection member then comprises only the single plastic member which includes the latching elements and the inserted supporting member for the spindle.

In a further preferred embodiment, the ball and the moveable supporting plate, if present, are maintained in position by the housing itself when the drill is operating as a percussion drill. Further building elements for guiding and mounting the selection member are therefore also eliminated. The construction in accordance with the present invention can be utilized in a number of differently shaped housings

DRAWINGS ILLUSTRATING A PREFERRED EMBODIMENT

Figure 1:
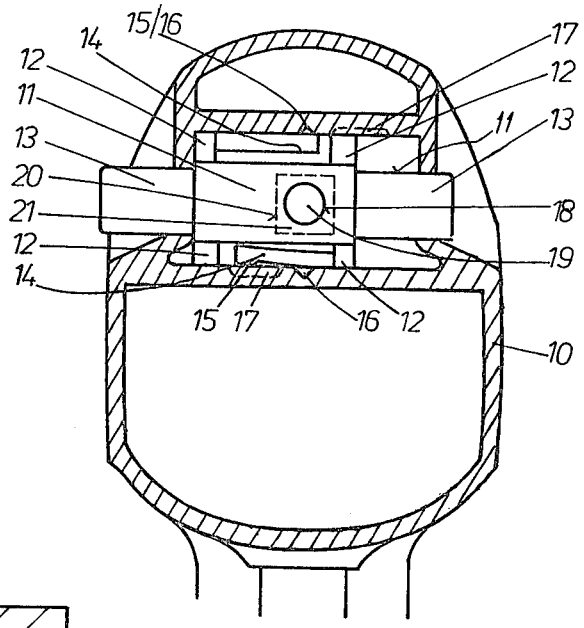
FIG. 1 is a cross section through the drill housing in the region of the selection member.

In FIG. 1, reference numeral 10 denotes the housing in which a selection slider 11 is slidably mounted. Slider 11 has projections 12 which abut inner guide surfaces of housing 10. Slider 11 has end sections 13 which may be pushed to move the slider transversely across the housing (compare FIGS. 2 and 3) from its first position wherein the drill is operating as a rotary drill to its second position wherein the drill is operating as a percussion drill. End sections 13 project through recesses in housing 10. The portions of housing 10 which form these recesses cooperate with projections 12 to form stops which limit the movement of the slider in its lengthwise direction. An elongated latching element 14 extends from each projection 12, so that slider 11, porjections 12 and latching elements 14 form a single plastic structure. The latching elements are diagonally opposite each other and extend in opposite directions. Each latching element 14 has a free end with a cam-like projection 15. Each projection 15 engages a corresponding one of two latching detents 16 in the housing when the drill is operating as rotary and percussion drill respectively. Depending upon the material used for latching elements 14, it may be desirable to provide further detents 17 in the housing to receive projections 15 when the latter are not engaged in the detents 16. The further detents would prevent fatiguing of the material and a resulting decrease of the retaining power of the detent mechanism.

A circular opening 18 is provided in the central region of slider 11 to receive a ball 19. A further square recess 20 is also provided to receive a bearing plate 21. The spindle is denoted by reference numeral 22.

Figure 2:
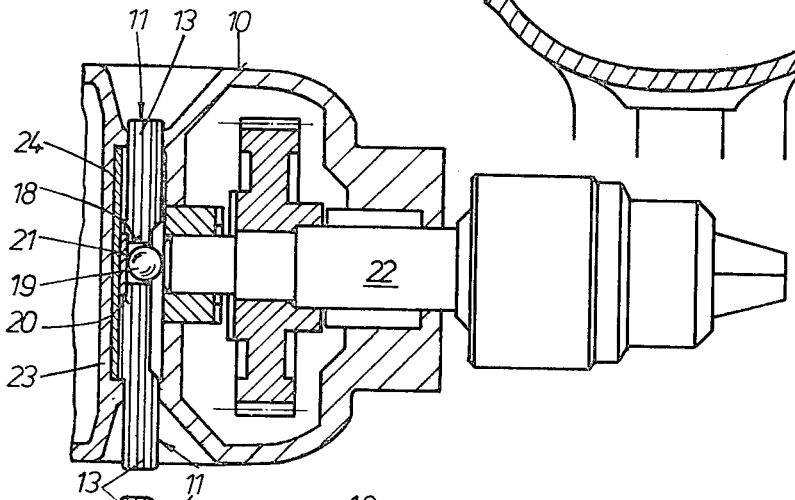
FIG. 2 is a longitudinal cross section of the front part of the drill when operative as rotary drill.
Figure 3:
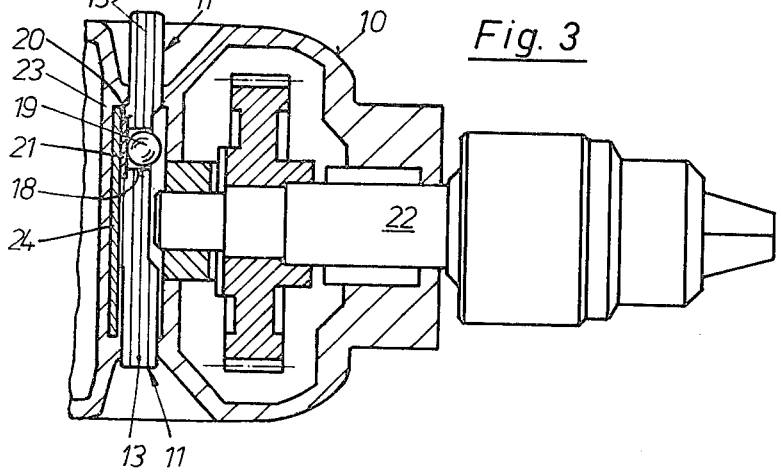
FIG. 3 is a longitudinal cross section of the same part of the drill when operative as a percussion drill.

Elements shown in FIGS. 2 and 3 which were shown in FIG. 1 have the same reference numerals. Further shown in FIGS. 2 and 3 is a stationary steel plate 24 mounted on a part 23 of the housing opposite slider 11. Bearing plate 21 slides on stationary steel plate 24. If bearing plate 21 is eliminated to simplify the construction, then ball 19 rolls directly on steel plate 24.

OPERATION

To switch the drill from rotary to percussion type operation, a sidewise push applied to end portions 13 of slider 11 cause it to move in the lengthwise direction within housing 10 in such a manner that the latching elements shown in FIG. 1 engage the upper or the lower recess 16 with one of their projections 15 thereby arresting the slider in the first or the second position. Movement of slider 11 causes a corresponding movement of ball 19 which is in opening 18 and of bearing plate 21 which is in recess 20. In the arrangement shown in the figures, bearing plate 21 ends flush with the top surface of slider 11 which faces steel plate 24. Use of the small and relatively inexpensive bearing plate 21 prevents deformations in ball 19 which would interfere with the slidability of slider 11. In FIG. 2, spindle 22 thrusts against ball 19 and is axially maintained in this position in such a manner that a ratchet supplied for percussion drill operation is disengaged. In the position shown in FIG. 3, the ratchet is engaged and spindle 22 together with the drill chuck execute a translatory movement corresponding to the rotational movement of the ratchet, since the end of spindle 22 away from the chuck is free to move within the required limits.

Various changes and modifications may be made within the scope of the inventive concept.

I claim:

1. In a drill selectively operable as rotary drill or percussion drill, mounted in a housing (10) having a recess, said drill having a spindle having a longitudinal axis, the improvement comprising a ball (19) forming a bearing member;

a plastic slider (11) mounted in said recess for movement, under external control, from a first position wherein said drill is operative as a rotary drill to a second position wherein said drill is operative as a percussion drill, said plastic slider having an opening (18) aligned with said spindle along said longitudinal axis thereof when in said first position, the ball (19) being located in said opening for constituting a thrust bearing for said spindle when said drill is operative as rotary drill;

a bearing plate (21) positioned in said further recess, said bearing plate and said ball together constituting said thrust bearing for said spindle when said drill is operative as rotary drill;

and at least one latching element (14) formed on the slider for selectively latching said slider in said first or said second position, whereby the plastic slider and the latching elmeent will form a single unitary plastic member.

2. A drill as set forth in claim 1, wherein said plastic slider (11) is formed with a first and second elongated latching element (14) each restrained at one end and having, respectively, a first and second free end carrying a first and second camlike projection (15);

and wherein said housing further has a first and second latching recess (16) for receiving said first and second cam-like projection when said slider is in said first or second position respectively.

3. A drill as set forth in claim 1, wherein said plastic slider has a first and second end portion (13) for receiving an externally applied push force for moving said slider from said first to said second and from said second to said first position.

4. A drill as set forth in claim 3, wherein said plastic slider is mounted opposite a predetermined part of said housing for movement relative thereto;

and wherein said improvement further comprises a stationary steel plate (24) mounted in said predetermined part of said housing and extending from said first to said second position in the direction of movement of said slider.

5. A drill as set forth in claim 1, wherein said plastic slider is positioned relative to said housing in such a manner that said ball and said bearing plate are retained in said opening and said further recess by said housing when said plastic selection member is in said second position.

6. A drill as set forth in claim 1, wherein said bearing plate is made of case hardened steel.

7. A drill as set forth in claim 1, wherein said slider (11) is slidable in the housing (10) transversely with respect to the longitudinal axis of the spindle.

* * * * *